US010273044B2

(12) United States Patent
Thielen et al.

(10) Patent No.: US 10,273,044 B2
(45) Date of Patent: Apr. 30, 2019

(54) CAN LID

(71) Applicant: Gregor Anton Piech, Eichelwang (AT)

(72) Inventors: Klaus Thielen, Schönau am Königssee (DE); Eva-Maria Thielen, Schönau am Königssee (DE)

(73) Assignee: Gregor Anton Piech, Ebbs (AT)

( * ) Notice: Subject to any disclaimer, the term of this patent is extended or adjusted under 35 U.S.C. 154(b) by 0 days.

(21) Appl. No.: 15/546,503

(22) PCT Filed: Apr. 1, 2016

(86) PCT No.: PCT/EP2016/057225
§ 371 (c)(1),
(2) Date: Jul. 26, 2017

(87) PCT Pub. No.: WO2017/016686
PCT Pub. Date: Feb. 2, 2017

(65) Prior Publication Data

US 2018/0016058 A1 Jan. 18, 2018

(30) Foreign Application Priority Data

Jul. 29, 2015 (DE) ..... 10 2015 112 428

(51) Int. Cl.
*B65D 17/28* (2006.01)
*B65D 17/50* (2006.01)

(52) U.S. Cl.
CPC ..... *B65D 17/506* (2013.01); *B65D 17/4014* (2018.01); *B65D 2517/0013* (2013.01); *B65D 2517/0062* (2013.01); *B65D 2517/5064* (2013.01)

(58) Field of Classification Search
CPC ... B65D 17/506; B65D 17/507; B65D 17/508
USPC ..... 220/270, 265, 266, 258.6, 257.2, 256.1, 220/254.1
See application file for complete search history.

(56) References Cited

U.S. PATENT DOCUMENTS

| | | | | |
|---|---|---|---|---|
| 3,287,053 | A * | 11/1966 | Stec | B65D 17/506 222/545 |
| 3,804,287 | A * | 4/1974 | Balocca | B65D 17/503 220/271 |
| 2013/0206766 | A1* | 8/2013 | Ramsey | B65D 17/506 220/258.2 |

FOREIGN PATENT DOCUMENTS

| | | | |
|---|---|---|---|
| DE | 8911286 | U1 | 12/1989 |
| DE | 9005150 | U1 | 8/1990 |
| DE | 19613246 | A1 | 10/1997 |
| DE | 102010013531 | A1 | 10/2011 |
| EP | 1607341 | A1 | 12/2005 |
| EP | 2354022 | A1 | 8/2011 |
| GB | 1389351 | | 4/1975 |
| NL | 2007748 | C | 5/2013 |
| WO | 2008098558 | A1 | 8/2008 |

* cited by examiner

*Primary Examiner* — Steven A. Reynolds
*Assistant Examiner* — Javier A Pagan
(74) *Attorney, Agent, or Firm* — Vivacqua Law

(57) ABSTRACT

A reclosable can lid is described that has a collar part and a lid receiving part composed of plastic that can be coupled to one another via a snap-in latching connection, wherein a tear line closed in itself is either partly perforated or is formed as a toothed separating line and the leak-tightness is ensured by a sealing film provided at the inner side of the lid cover.

17 Claims, 7 Drawing Sheets

CAN LID

CROSS REFERENCE TO RELATED APPLICATIONS

This application is a national stage application under 35 U.S.C. 371 of PCT Application No. PCT/EP2016/057225 having an international filing date of 1 Apr. 2016, which PCT application claimed the benefit of German Patent Application No. 10 2015 112428.9 filed 29 Jul. 2015, the entire disclosure of each of which are hereby incorporated herein by reference.

INTRODUCTION

The invention relates to a can lid having a sealingly reclosable opening in accordance with the preamble of claim 1.

Such a reclosable can lid is known from DE 10 2010 013 531 A1.

A comparable can lid of this kind is furthermore described in EP 2 354 022 B1.

A can lid having a reclosable opening is known from EP 1 607 341 A1 in which an opening is introduced in the metallic can lid and the margin of this opening is beaded to create an anchorage possibility for a prefabricated plastic closure part. The plastic closure part encloses a base part which is to be connected to the bead rim of the can opening and in which an opening closed by a flat stopper is formed. The flat stopper is connected to the opening margin via a plastic tear seam so that the flat stopper connected to a tear tab can be released from the plastic base part via the tear tab by exertion of a pull and can be pivoted into an open position. The opening can be temporarily closed again by pressing in the flat stopper which is preferably conical at its lower side.

A can lid having a reclosable opening is known from WO 2008/098558 A1 in which an opening into which a prefabricated tearable plastic closure part is inserted is likewise introduced in the metal can lid, with the prefabricated plastic element having a double flange at the marginal side into which the margin of the stamped-out can opening engages and is fixed therein. The prefabricated plastic element includes a closure part which is connected to the peripheral margin of the plastic part via a tear seam. A tear tab connected to the closure part makes it possible to tear open the plastic tear seam between the peripheral region of the plastic part and the lid part and to release the can opening in this manner. For the purpose of reclosing, the closure part which preferably remains in connection with the peripheral region via a tab region is pressed back into the opening.

A reclosable can lid is known from GB 1 389 351 in which in particular the creation of sharp edges should be avoided such as occur on opening typical sheet metal cans via a tab. For this purpose, a punching provided in the metallic can lid is snapped into a prefabricated plastic part which has a lid part which is connected to the base part snapped into the can opening via a thin plastic wall. The thin connection wall between the connection part and the base part can be destroyed via a tear tab and the can opening can be exposed. The closure part is designed in this respect such that it engages into the base part via a snap-in latching connection to reclose the opening.

A beverage can is known from DE 89 11 286 U having a press-in lid closure in which the tear tab is rotatably supported at the lid wall and a closure element is provided at said lid wall which is taken along on the rotation of the tear tab from the tear position into a closure position above the opened pouring opening and the pouring opening engages into it in an overlapping or closing manner.

A beverage can is known from DE 90 05 150 U having a lid which is composed of sheet metal, in which an attenuating line is formed and the lid part bounded by the attenuating line can be separated by means of a pull tab, with a closure part for the removal opening pivotable substantially in parallel with the lid surface being captively fastened to the lid.

A lid of metal for beverage cans is known from DE 196 13 246 which has a prepunched pouring opening in the lid surface which is sealingly closed by means of a closure element and can be sealingly closed again after the first opening. In this respect, the lid and the closure element can be connected to one another in a shape-matched manner by elements which engage into one another in the manner of a bayonet and which are formed directly from the lid material or from the closure element.

SUMMARY

It is the object of the present invention to further develop the reclosable can lid in accordance with the preamble of claim 1 in a manner such that, while maintaining a high-quality gas-tight and liquid-tight closure, the functionality is further improved and above all the process of opening the can is facilitated or the exertion of force required therefor is reduced and such that furthermore the production of the can lid can be simplified and made less expensive and the automatic assembly can be made substantially more favorable in comparison with previous solutions due to the construction design.

This object is substantially satisfied in that the collar part and the lid receiving part each have a plurality of noses molded on and arranged distributed in annular form, in that these noses extend through adapted openings in the metallic lid part, and in that the collar part and the lid receiving part are connected to the metallic lid part in a shape-matched and force-transmitting fashion as well as sealingly while interposing an adhesion promoting layer by a rivet-like deformation of the noses under the effect of heat.

A separate production of the plastic components and metal components is made possible by these measures and a technical injection fabrication of compound parts of metal and plastic is avoided, whereby substantial technical production advantages can be achieved without any functional compromises.

To achieve secure and permanent connections between the individual components of the can lid, provision is preferably made that the adhesion promoting layer or sealing layer that reacts at an elevated temperature extends over both surfaces of the metallic lid part, i.e. over the outer and inner surfaces of this lid part.

It is ensured by the sealing layer provided in this manner, which can be a sealing wax, that the plastic materials are connected sealingly and fixedly to the metal parts, which preferably takes place by heat sealing at an elevated temperature, for example at approximately 150° C. to 160° C.

An embodiment variant of the invention is characterized in that the opening region bounded by a peripheral tear line is connected to the adjacent lid region by an attenuating groove that is partly perforated, in particular in the start and end regions associated with the tearing movement.

The force required for the opening of the closure can be reduced in a defined manner by the provision of suitably arranged partial perforations, with the leak-tightness also being reliably ensured in this case, and indeed by the layer of plastic material provided over the full surface at the lower side of the metallic lid and attached in a firmly adhering manner or by the correspondingly attached plastic film.

From a technical production aspect, a substantial advantage results in accordance with a further embodiment of the invention in that the collar part, the lid receiving part and the pull tab comprise the same plastic material, in particular polypropylene, and are formed by a single injection molded part that coheres via connection tabs, that can be transformed by folding into an assembly unit and that can be connected to the metallic lid part in a connection step via the noses associated with the openings in the metallic lid part.

This is above all also made possible in that the metallic can lid is provided at both sides over the full surface with the already mentioned sealing layer that makes it possible to injection mold all the plastic components or plastic parts from one single component, in particular polypropylene, in one process and nevertheless to ensure firm and sealing connections to the metallic can lid. The three elements of the same plastic component connected to one another are folded onto one another such that an element is present such that the rivet-like connection and heat sealing can take place while the sealing layer becomes effective by pressing the projections provided at the plastic parts into the can lid regions provided with the corresponding openings.

In accordance with a further embodiment of the invention, provision is made to ensure the long-term leak-tightness of the overall arrangement that the lid receiving part is sealingly connected at its outer peripheral margin contacting the metallic can lid to said metallic can lid by heat sealing.

The pull tab preferably has at least one nose that extends up to the metallic can part and that is connected to the lid part during a sealing step.

A snap-in latching connection generally particularly advantageous for closures of containers having a lid part is characterized in that the snap-in latching connection between the collar part and the lid receiving part comprises a coupling and sealing rib that is provided at the lid receiving part and that engages into a first adapted recess in the collar part and comprises a preloading and latching lip that latchingly engages into a second recess of the collar part and presses the wall rib between the two recesses toward the coupling and sealing rib.

A further embodiment of the invention that is also of particular advantage independently of the type of connection of the plastic parts to the metal parts and independently of whether only one plastic material or a plurality of plastic materials is/are used, is characterized in that the opening region of the metallic can lid is separated from the lid surface surrounding it while forming mutually engaging projections and recesses by a cutting process, in particular a punching process; in that the opening region and the lid surface surrounding it are held together as a component in a shape-matched and force-transmitting manner via these projections and recesses; and in that the leak-tightness of the finished, unopened can lid is ensured by the inwardly disposed plastic coating or film.

The projections and recesses are in this respect preferably coupled via undercuts.

This particularly significant embodiment variant of the invention in which the opening region of the can lid is first cut out or punched out while forming a toothed structure and this punched-out lid opening region is pressed directly after this into the toothed arrangement of the remaining part of the can lid such that a single-part structure is in turn present that can be brought to the next station in the production and can be connected to the plastic part has the result that an absolutely splintering free opening of the lid part that can be pivoted upward is possible and the opening process can be carried out with a particularly small exertion of force. This is a consequence of the fact that no metallic attenuating grooves have to be torn open in the opening process since the metallic regions to be separated from one another are already completely separated from one another by the punching process. The leak-tightness of this arrangement is in turn also ensured by the inwardly disposed plastic film that has a peripheral attenuating groove or notch directly adjacent to the opening region such that the opening process is also not made more difficult by this film ensuring the leak-tightness.

BRIEF DESCRIPTION OF THE DRAWINGS

Embodiments of the invention will be described in the following with reference to the drawings.

There are shown in the drawings.

DETAILED DESCRIPTION

Figure 1:
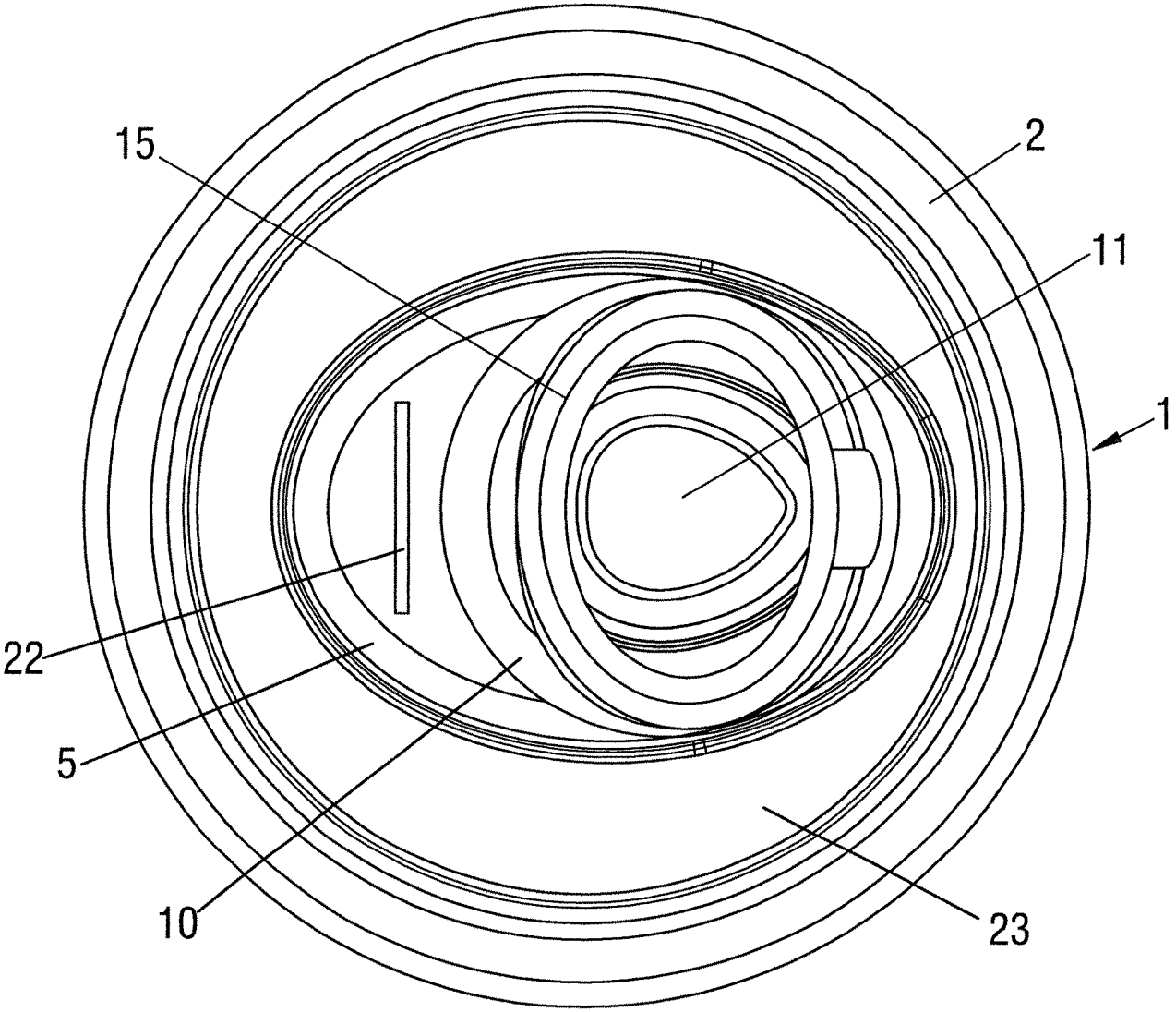
FIG. 1 is a plan view of a reclosable can lid in accordance with the invention.

FIG. 1 shows a can lid 1 that is designed conventionally in its base shape, that is composed of metal and that is connected in a liquid-tight and gas-tight manner to the respective associated can via a bead rim 2 while interposing a sealing material.

A reclosable opening is integrated in this lid, offset off-center, as will still be explained in detail.

A collar part 5 can be recognized in FIG. 1 that is connected to a tear tab 15, that surrounds the opening region and that is fixedly connected to the can lid surface 23. A lid receiving part 10 surrounds the opening region 11 and can be pivoted upwardly by means of the tab 15 in the opening process. A kink spring element 22 in this respect ensures that the upwardly pivoted lid is held in the open position when it is in particular pivoted open by more than an angle of 90°.

It can also be seen from FIG. 1 that the reclosable opening with all its associated components is arranged off-center, and indeed such that the stackability as with conventional cans is maintained unchanged despite the presence of the reclosable opening.

The requirement for this is above all, in addition to the positioning, the compact design of the reclosable opening in accordance with the invention. The overhang of the components of the reclosable opening over the can surface amounts to only approximately 2 mm in accordance with the invention.

Figure 2:
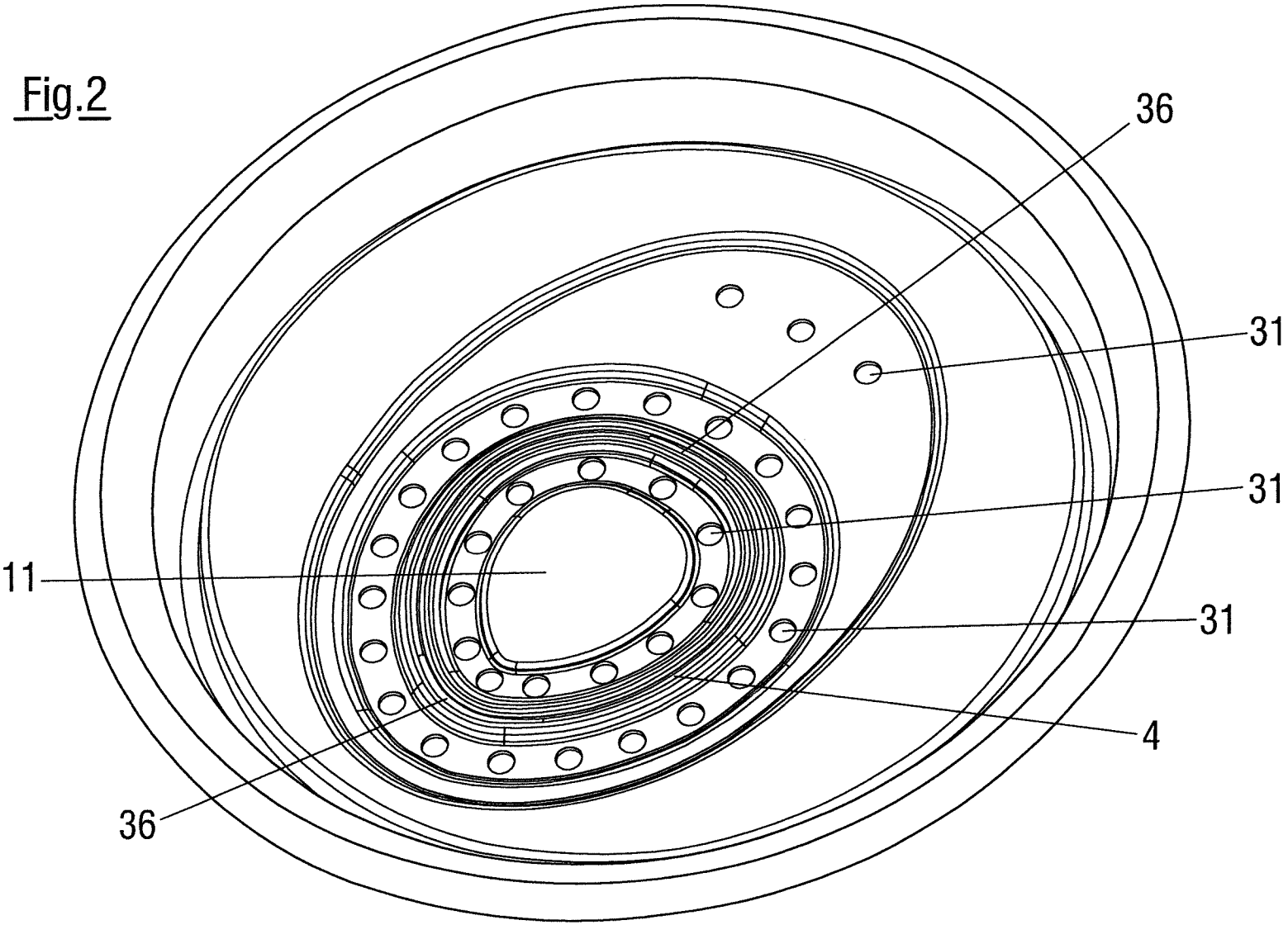
FIG. 2 is a perspective representation of the punched metallic lid surface before the connection to the plastic components of the closure.

FIG. 2 shows the metallic can lid of an advantageous embodiment of the invention formed as a punched part before the connection to the associated plastic components of the reclosable lid.

Continuous openings 31 can be seen in this representation that serve for the connection of the plastic components to the metallic can lid and that are arranged in annular form at both sides of an attenuating groove or tear notch 4. A special feature of the embodiment of the attenuating groove or tear notch 4 comprises it not being continuous, unlike in conventional solutions, but rather having perforations 36 that produce the advantageous effect that the opening process is facilitated, i.e. the force required to open the upwardly pivotable lid part is reduced. These perforations 36 are formed during the punching process of the lid, but leave the lid part as a uniform punched part. The leak-tightness to be ensured by the can lid is not impaired by the perforations 36 because the required leak-tightness is ensured by an inwardly disposed sealing film that extends over the total inner can lid surface and also into the bead region.

Figure 3:
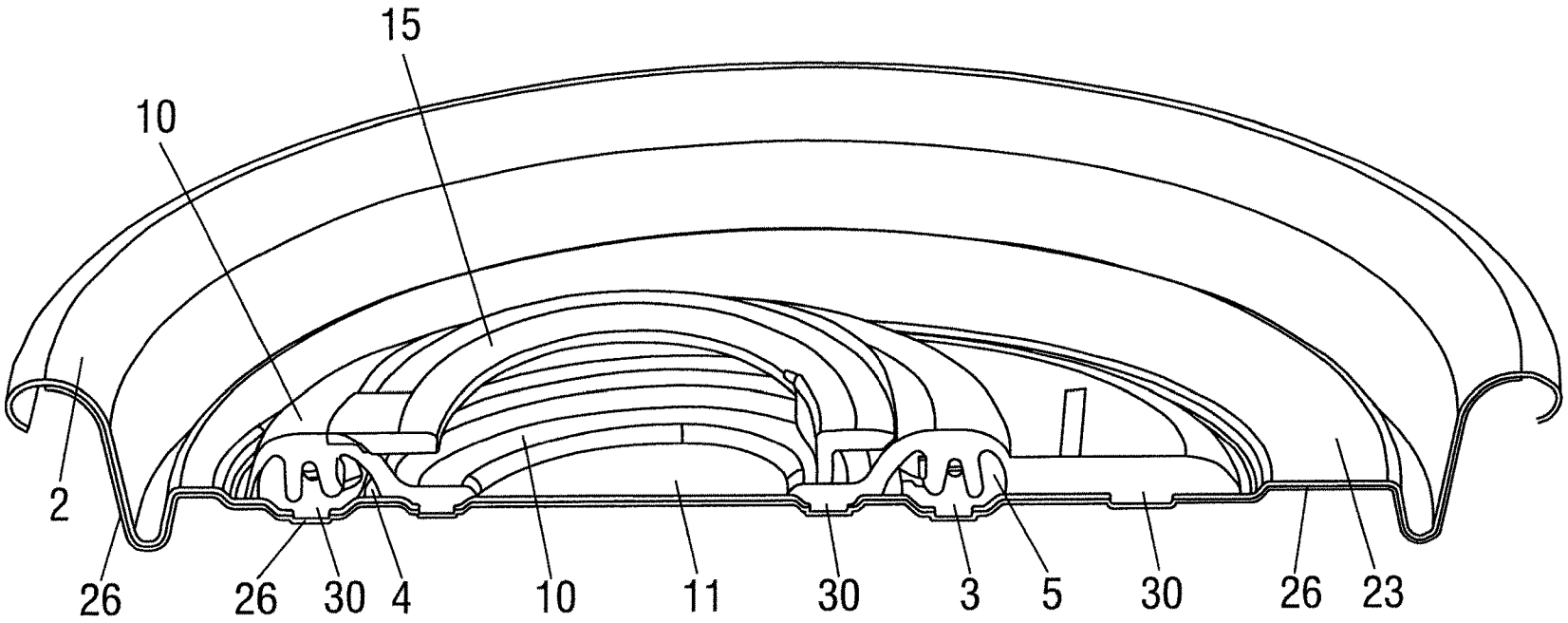
FIG. 3 is a perspective sectional representation of the can lid in accordance with FIG. 1.

FIG. 3 shows a cross-sectional representation of the can lid in accordance with FIGS. 1 and 2, with the arrangement being shown in the closed state.

The region of the can lid disposed within the tear line 4, i.e. the opening region 11, is surrounded by a lid receiving part 10 composed of plastic that is fixedly and sealingly connected to this metallic region, and indeed by means of a plurality of molded projections 32 that extend through the openings 31 shown in detail in FIG. 2. A fixed connection is established by a rivet-like deformation of these projections 32 under the effect of heat, with it being important, however, that a bonding agent reacting under heat is provided at the contact surfaces between the plastic part and the metal part. Both the outer surface and the inner surface of the metallic can lid are preferably coated with a material effective and suitable as a bonding agent, in particular in the manner of a sealing wax, such that the bonding agent is available wherever it is needed for connection and sealing purposes.

To cooperate with the lid receiving part 10 in the form of a snap-in latching connection, a collar part 5 is provided radially outside the opening region that is composed of plastic and that is connected to the metallic can lid in the same manner as the lid receiving part 10 via noses 30 passing through openings 31.

The provision of a plastic layer or plastic film that extends over the total lower side of the can lid up to and into the region of the bead rim 2 and covers this lower side over the whole surface is important both for the selected connection technique between the metal and the plastic parts and in particular for the configuration of the tear line or attenuating groove 4. This plastic layer 26 is in turn formed with the metallic can lid via an adhesive agent, in particular via a lacquer that becomes effective or reacts on an introduction of heat. It can be seen from FIG. 3 that this sealing layer extends both over the mechanical connection points between the metal parts and plastic parts and over the attenuating groove 4.

The substantial advantage of the described connection technique between the metallic lid and the plastic components comprises the punched metal part and the plastic parts being able to be produced separately, no metal overmolding processes being necessary, and the connection between the metallic can lid and the plastic components being able to take place in one workstep when the plastic components are applied to the metallic surface and the projections 30 pass through the openings 31.

Figure 4:
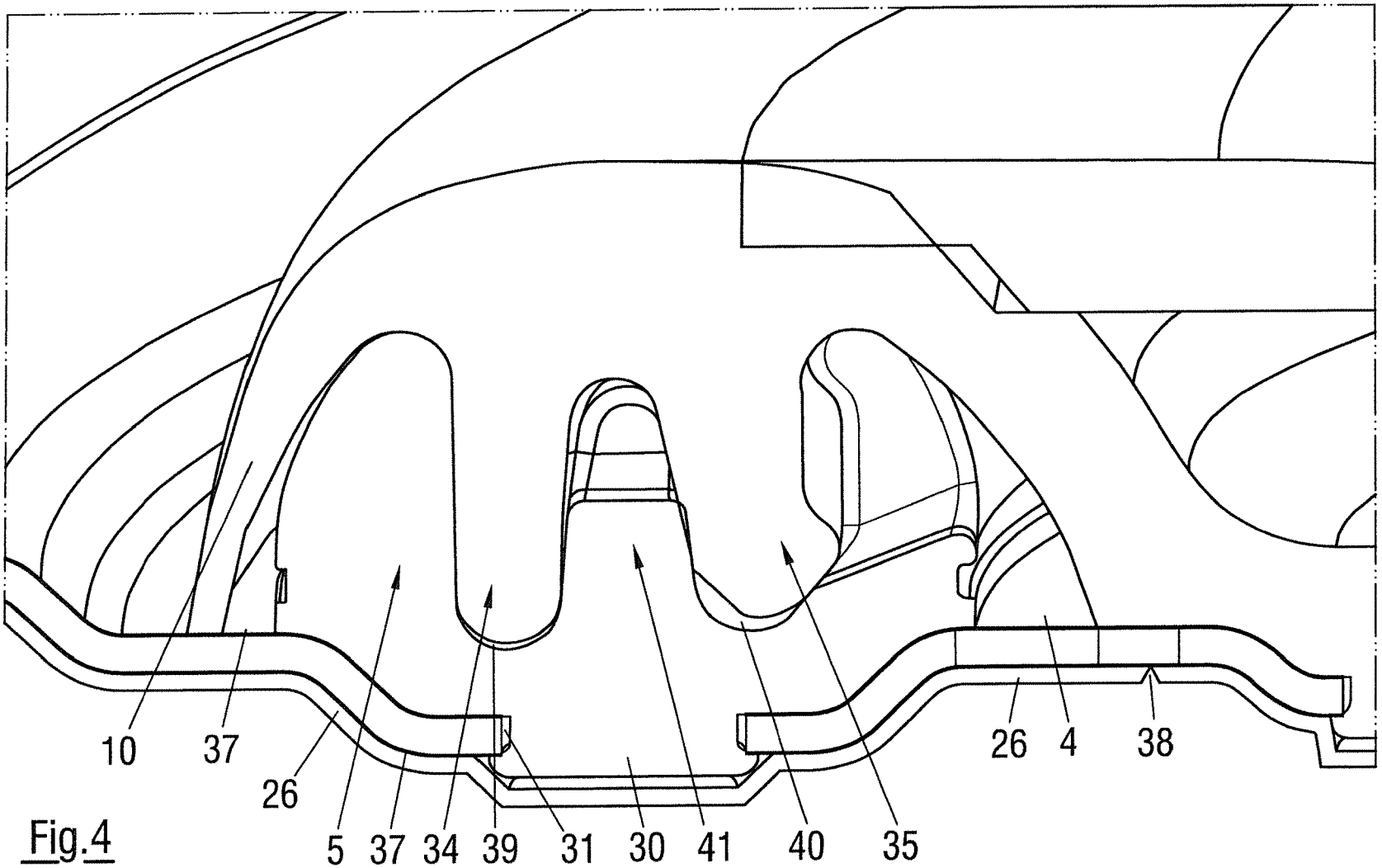
FIG. 4 is an enlarged detail representation for explaining the sealing coupling between a collar part connected to the container and a lid receiving part.

The detailed representation in accordance with FIG. 4 shows a design principle that can generally be used for snap-in latching connections and that is advantageously also used for the reclosable can lid in accordance with the invention.

For this purpose two peripheral ribs are provided at the lid receiving part 10, namely an outwardly disposed coupling and sealing rib 34 and in inwardly disposed preloading and latching rib 35. The coupling and sealing rib 34 sealingly engages into a first recess 39 of the collar part 5, while the preloading and latching rib 35 extends into a second recess 40 of the collar part 5 and a snap-in latching connection is provided between this rib and the recess. It is, however, also important that this rib 35 is dimensioned and designed such that it presses toward the middle wall rib 41 of the collar part in the latched state such that this wall part is pressed toward the sealing rib 39 and thus the sealing effect becomes even more secure and better.

It can also be seen from FIG. 4 that the metallic lid cover is covered at both sides and over the whole surface with an adhesion promoting layer 37, which also makes it possible to fix the outer margin of the lid receiving part 10 that contacts the metallic can lid surface in a sealing manner via the adhesion promoting layer to improve the leak-tightness of a filled can.

With a reclosable can lid, however, not only demands with respect to the leak-tightness have to be satisfied, but it must also and above all be achieved that the can is able to be opened simply and with a small exertion of force. The easily and comfortably grippable pull tab 15 contributes to this, on the one hand, but it is above all important for the invention that the required tearing force is as small as possible. The already mentioned provision of perforations 36 along the tear open line or along the attenuating groove corresponds to this objective and there is additionally the fact that the inwardly disposed plastic film 26 is provided with a peripheral attenuating notch 38 next to the tear line so that the film 26 can also not impede the opening process in a disturbing manner.

The representations in FIGS. 5*a* to 5*c* show a particularly advantageous embodiment of the invention that comprises all the plastic components of the reclosable can lid comprising the same plastic material and a production of these plastic components thereby being able to take place in a single injection molding process.

As can be seen from the representations, the collar part 5, the lid receiving part 10 and the pull tab 15 are injected lying in one plane and connected to one another by connection tabs 42 such that a practically single-part total structure is obtained that can be handled as a unit in the production process and only has to be folded over one another for the assembly at the can lid such that the noses 30 of the collar part 5 and the lid receiving part 10 that are then disposed approximately concentrically to one another can be pressed through the openings 31 in the metallic can lid in a single pressing process and can then be deformed in the already described manner.

As can be seen, a corresponding handling and assembly advantage is also obtained in addition to the simplification of the production of the plastic component comprising the same material and reacting with the suitable bonding agent 37 that can be achieved in this manner.

Figure 5:
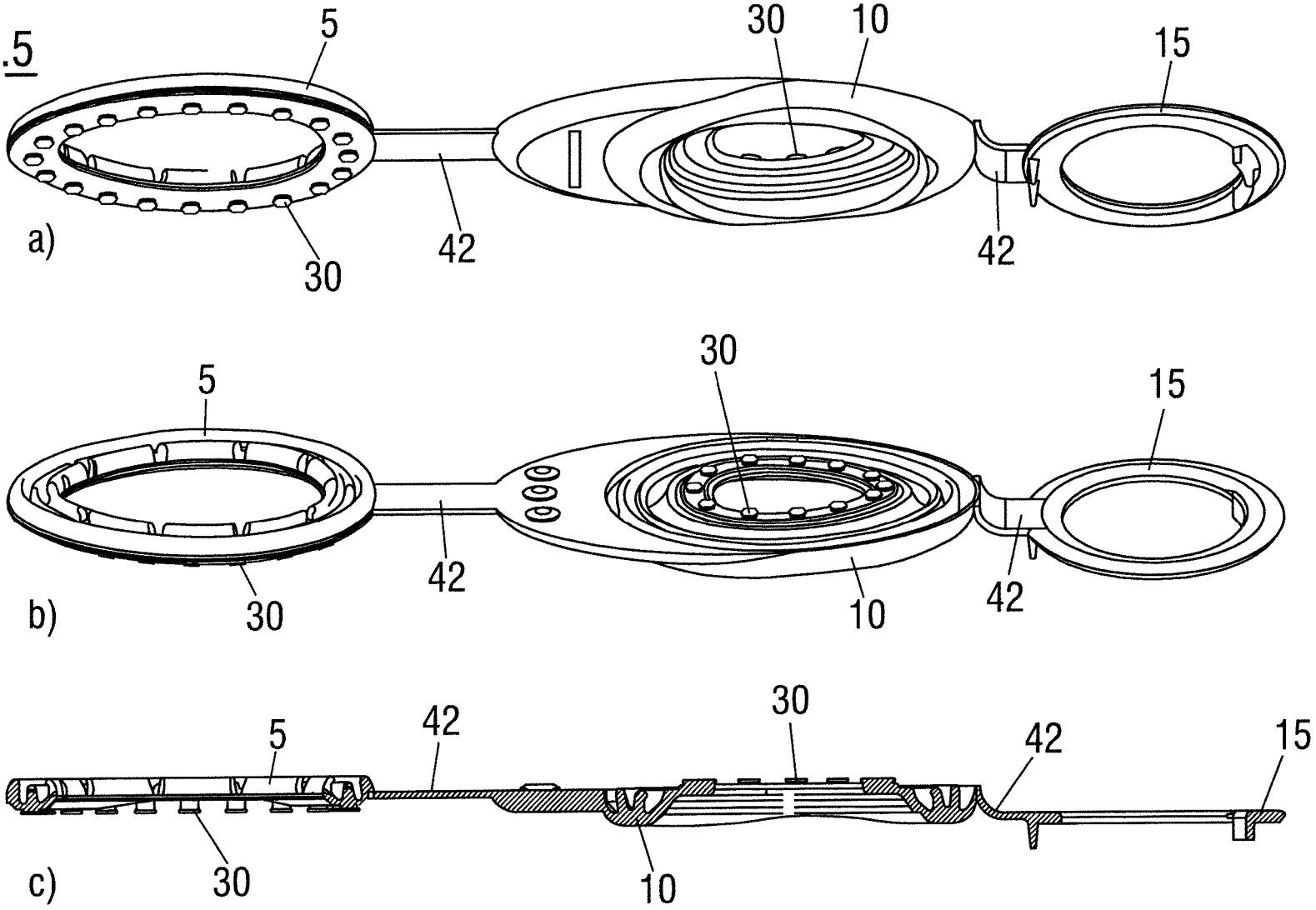
FIGS. 5A to 5C are representations to explain the production of all plastic components of the closure in one production step.
Figure 6:
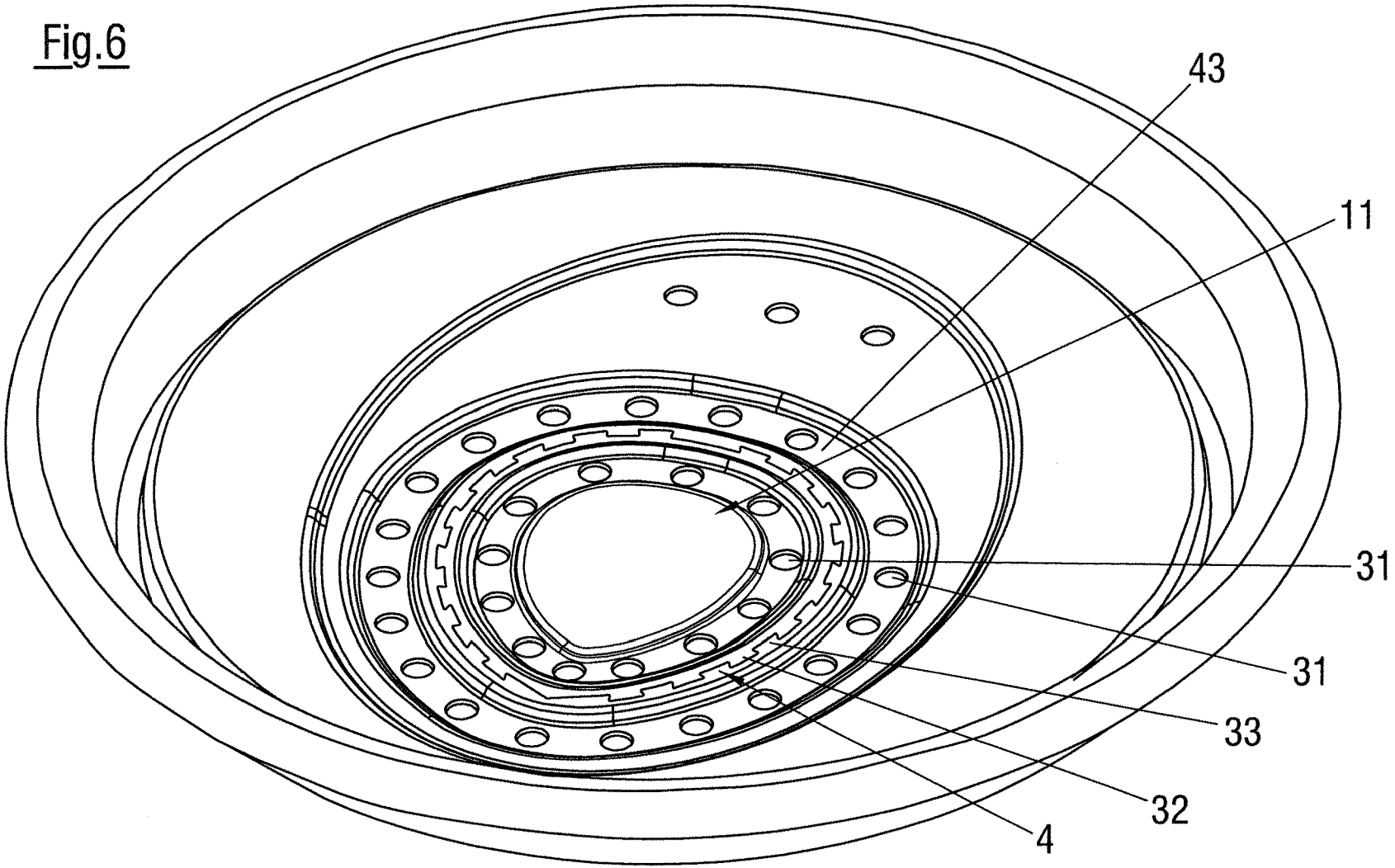
FIG. 6 is a perspective plan view of a particularly preferred embodiment of the metallic can lid part before connection to the plastic components.

FIG. 6 shows a particularly preferred embodiment of a can lid in accordance with the invention, wherein the metallic can lid part shown in this FIG. 6 can in particular be combined with the plastic elements in accordance with FIG. 5 to form a finished reclosable can lid.

Whereas in known reclosable standard can lids an unwanted and unavoidable gap formation or the creation of very small metallic aluminum particles occurs on the opening by tearing a metallic attenuating groove, the embodiment in accordance with the invention in accordance with FIG. 6 allows an opening that is completely free of splintering and eliminates dangers to the health.

For this purpose, the opening region 11 of the metallic can lid is separated from the outer, fixed can surface 43 surrounding it by a cutting process or in particular by a punching process, and indeed while forming mutually engaging projections 32 and recesses 33, such as is shown in FIG. 6.

Directly after the preferably used punching process, the two initially separated parts are again joined to one another in a shape-matched manner such that the two parts practically become one part again that can be handled as a single part. The processes of separating and joining together take place directly after one another, i.e. the punching stroke is followed in the return stroke by the shape-matched joining together of both parts to form a total part. The shape-matched and force-transmitting connection between the two parts is achieved by suitable shaping or by using undercuts that ensure a sufficient mutual mechanical connection to be able to handle the parts already separated from one another as a uniform assembly part in production.

Figure 7:
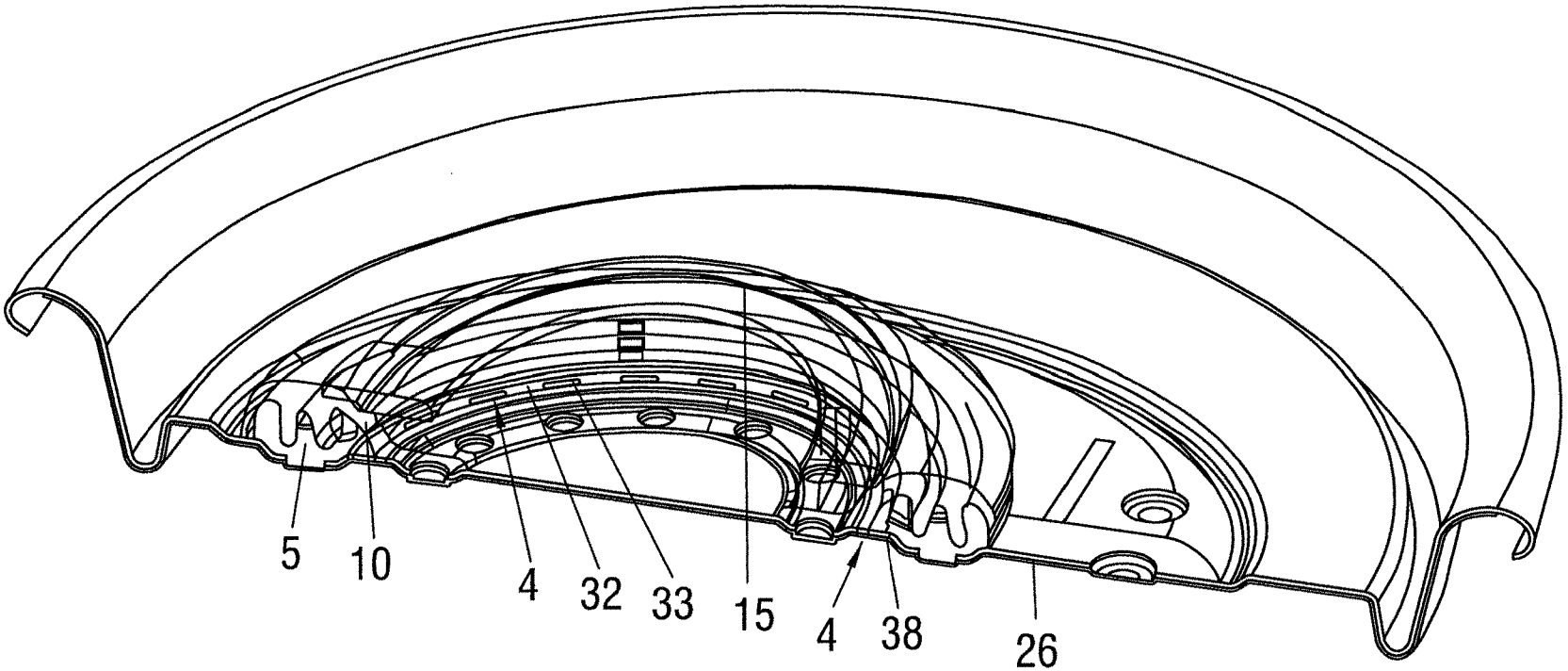
FIG. 7 is a sectional representation of the can lid in accordance with FIG. 6 with schematically drawn plastic components.

When the plastic components in accordance with FIG. 5 having the metallic can lid part in accordance with FIG. 6 are sealingly connected to one another in the already described manner and when the rear plastic film 26 is also applied, an arrangement is present such as is shown schematically in a sectional representation in FIG. 7.

In the representation in accordance with FIG. 7, the collar part 5 and the lid receiving part 10 are connected sealingly and permanently to the metallic can lid part in the already explained manner and the snap-in latching connection is in engagement. The leak-tightness is ensured by the film 26 extending up to the bead rim. The tear line 4 is formed by the separating line between the mutually engaging projections 32 and recesses 33.

If the filled can is opened via the pull tab, the projections 32 and recesses 33 defining the tear line move out of engagement, wherein, however, no attenuated metal regions have to be separated from one another while forming splintering, but rather only the present shape-matched connection has to be released, which is possible with a substantially smaller force effort than is required by tearing a still existing metallic connection between the two parts to be separated from one another.

The already mentioned use of the attenuating notch 38 in the inwardly disposed sealing film contributes to the demands made on such a reclosable can lid with respect to both leak-tightness and to minimized opening force being able to be ideally satisfied, and indeed with a simultaneously present economic production and assembly of all can lid components.

REFERENCE NUMERAL LIST

1 metallic can lid
2 bead rim
3 cover surface
4 attenuating groove or tear line
5 collar part
9 coupling rib
10 lid receiving part
11 opening region
12 recess
13 fixing region
15 pull tab
22 kink spring part
23 can lid surface
26 sealing plastic layer, film
30 nose
31 opening
32 projection
33 recess
34 coupling and sealing rib
35 preloading and latching rib
36 perforation
37 bonding agent, sealing wax
38 attenuating notch
39 first recess
40 second recess
41 wall rib
42 connection tab
43 fixed outer lid surface

The invention claimed is:

1. A can lid having a sealingly reclosable opening, the can lid comprising a bounded opening region provided in a metallic lid material of a lid surface as well as a two-armed lifting member intended to open this opening region, said lifting member being connected to a pull tab, on the one hand, and engaging at the opening region of the lid surface, on the other hand, and being supported via a bearing translating the opening force applied to the pull tab;

wherein the opening region is configured as a closure lid and is connected at its outer margin in a force-transmitting manner to a collar part composed of a plastic material, and wherein a lid receiving part that is connected in a force-transmitting manner to the lid surface outside the opening region and that is composed of a plastic material is associated with the collar part;

wherein the collar part furthermore engages over the lid receiving part and a sealing snap-in latching connection having at least one peripheral coupling rib and a cut-out shaped in complementary form thereto is formed between the collar part and the lid receiving part; and wherein the pull tab is fastened radially outside the lid receiving part to a fixing region of the collar part and the two-armed lever for opening the opening region is formed at a partial peripheral region of the collar part associated with the fixing region; and wherein the lower side of the metallic lid is coated and this coating is attenuated or thinner surrounding the opening region, wherein the collar part and the lid receiving part each have a plurality of molded noses arranged distributed in an annular manner;

wherein these noses extend through adapted openings in the metallic lid part; and wherein the collar part and the lid receiving part are connected to the metallic lid part in a shape-matched and force-transmitting manner as well as sealingly by a rivet-like deformation of the noses under the effect of heat while interposing an adhesive promoting layer.

2. The can lid in accordance with claim 1, wherein the adhesive promoting layer or sealing layer reacting at an elevated temperature extends over both surfaces of the metallic lid part, in particular over the outer and inner surfaces of this part of the lid.

3. The can lid in accordance with claim 1, wherein the opening region bounded by a peripheral tear line is connected to the adjacent lid region by an attenuating groove that is perforated at least in part.

4. The can lid in accordance with claim 3, wherein the attenuating groove is perforated in the starting and end regions associated with the tear movement.

5. The can lid in accordance with claim 1 wherein the collar part the lid receiving part and the pull tab comprise the same plastic material and are formed by an injection molded part that coheres via connection tabs, that can be transformed into an assembly unit by folding and that can be connected to the metallic lid material of the surface in a connection step.

6. The can lid in accordance with claim 5, wherein the plastic material is polypropylene.

7. The can lid in accordance with claim 1, wherein the outer peripheral margin contacting the metallic lid material of the surface of the lid receiving part is sealingly connected to this metallic lid material of the surface by hot sealing.

8. The can lid in accordance with claim 7, wherein the pull tab has a nose extending up to the metallic lid material of the surface that is connected to the can lid by sealing.

9. The can lid in accordance with claim 1, wherein the snap-in latching connection between the collar part and the lid receiving part comprises a coupling and sealing rib that is provided at the lid receiving part and that engages into a first adapted recess in the collar part and comprises a preloading and latching lip that latchingly engages into a second recess of the collar part and presses a wall rib between the first adapted recess and the second recess toward the coupling and sealing rib.

10. The can lid in accordance with claim 1 that is configured for beverage cans.

11. The can lid in accordance with claim 1, wherein the lower side of the metallic lid material of the surface is coated in a firmly adhesive manner over the full surface.

12. A can lid having a sealingly reclosable opening, the can lid comprising a bounded opening region provided in a metallic lid material of a lid surface as well as a two-armed lifting member intended to open this opening region, said lifting member being connected to a pull tab, on the one hand, and engaging at the opening region of the lid surface, on the other hand, and being supported via a bearing translating the opening force applied to the pull tab;

wherein the opening region is configured as a closure lid and is connected at its outer margin in a force-transmitting manner to a collar part composed of a plastic material, and wherein a lid receiving part that is connected in a force-transmitting manner to the lid surface outside the opening region and that is composed of a plastic material is associated with the collar part;

wherein the collar part furthermore engages over the lid receiving part and a sealing snap-in latching connection having at least one peripheral coupling rib and a cut-out shaped in complementary form thereto is formed between the collar part and the lid receiving part; and wherein the opening region of the can lid is separated from a fixed outer lid surface surrounding it by one of a cutting process and a punching process, and wherein the two initially separated parts are again joined to one another in a shape-matched manner such that the two parts practically become one part again that can be handled as a single part and wherein the lower side of the can lid is coated and this coating is attenuated or thinner surrounding the opening region.

13. The can lid in accordance with claim 12, that is configured for beverage cans.

14. The can lid in accordance with claim 12, wherein the can lid is coated in a firmly adhesive manner over the full surface with a plastic material.

15. The can lid in accordance with claim 12, wherein the opening region of the can lid is separated from the lid surface surrounding it while forming mutually engaging projections and recesses by a cutting process; wherein the opening region and the lid surface surrounding it are held together as a component in a shape-matched and force-transmitting manner via these projections and recesses; and wherein the leak-tightness of the finished, unopened can lid is ensured by the inwardly disposed plastic coating or film.

16. The can lid in accordance with claim 15, wherein the cutting process is a punching process.

17. The can lid in accordance with claim 15, wherein the projections and recesses are coupled via undercuts.

* * * * *